US012607101B2

(12) United States Patent
Horn et al.

(10) Patent No.: US 12,607,101 B2
(45) Date of Patent: Apr. 21, 2026

(54) DOWNHOLE APPARATUS AND METHODS

(71) Applicant: DeltaTek Oil Tools Limited, Aberdeen (GB)

(72) Inventors: Tristam Paul Horn, Westhill (GB); Stephen Edmund Bruce, Blairgowrie (GB); David Michael Shand, Banchory (GB)

(73) Assignee: EXPRO NORTH SEA LIMITED, Dyce (GB)

( * ) Notice: Subject to any disclaimer, the term of this patent is extended or adjusted under 35 U.S.C. 154(b) by 98 days.

(21) Appl. No.: 18/386,897

(22) Filed: Nov. 3, 2023

(65) Prior Publication Data

US 2024/0151122 A1 May 9, 2024

(30) Foreign Application Priority Data

Nov. 4, 2022 (GB) ..... 2216431

(51) Int. Cl.
*E21B 43/10* (2006.01)

(52) U.S. Cl.
CPC ..... *E21B 43/101* (2013.01)

(58) Field of Classification Search
CPC ..... E21B 43/101; E21B 33/143; E21B 33/14; E21B 33/13
See application file for complete search history.

(56) References Cited

U.S. PATENT DOCUMENTS 3,001,585 A * 9/1961 Shiplet ..... E21B 33/146 166/147
3,139,931 A * 7/1964 Simpson ..... E21B 33/14 166/116
6,098,710 A * 8/2000 Rhein-Knudsen ..... E21B 43/10 166/386
2005/0274547 A1 12/2005 Fincher
2007/0029082 A1* 2/2007 Giroux ..... E21B 33/14 166/387
2012/0279705 A1 11/2012 Moffitt
2015/0184461 A1 7/2015 Twardowski
2020/0263533 A1* 8/2020 Bruce ..... E21B 47/005

FOREIGN PATENT DOCUMENTS

WO 2021028689 A1 2/2021
WO 2021181087 A1 9/2021

* cited by examiner

*Primary Examiner* — Yanick A Akaragwe
(74) *Attorney, Agent, or Firm* — Getz Balich LLC

(57) ABSTRACT

A well construction method in which a drilled bore is lined with a plurality of successively smaller diameter sections of bore-lining tubing including casing sections a liner section is provided. A liner is provided with an inner string extending to a distal end of the liner. The liner and the inner string are run into a distal section of a drilled bore. Settable material is pumped from surface through the inner string and through the distal end of the liner to partially fill an outer annulus surrounding the liner. Fluid displaced from the outer annulus and a portion of the settable material is permitted to flow from the outer annulus through a port in the liner and into an inner annulus between the inner string and the liner.

19 Claims, 3 Drawing Sheets

DOWNHOLE APPARATUS AND METHODS

This application claims priority to GB Patent Appln. No. 2216431.3 filed Nov. 4, 2022, which is hereby incorporated by reference in its entirety.

BACKGROUND OF THE INVENTION

1. Technical Field

This disclosure relates to downhole apparatus and methods, and to well construction apparatus and methods.

2. Background Information

In the oil and gas exploration and production industry wells are constructed to provide access to subsurface hydrocarbon-bearing rock formations, with a bore being drilled from surface to intersect the hydrocarbon-bearing formation. After drilling a section of bore, metal tubing is placed in the bore and an annulus between the tubing and the wall of the drilled bore is sealed with cement. Successive bore sections are lined with smaller diameter metal tubing. The metal tubing may extend back to surface, or in sub-sea wells back to the wellhead housing located at the seabed, such tubing being generally known as casing. Alternatively, the tubing may only extend part way up the bore, such tubing sometimes being referred to as liner, but also sometimes referred to as casing; in the interest of brevity, in this document such tubing will typically be referred to as "liner". A work or running string is used to support a section of liner as the liner is run into the bore, and the arrangement of supports, slips (gripping elements) and seals which secure and seal the upper end of a liner to the adjacent tubing is typically referred to as a liner hanger.

When a section of casing or liner is being cemented in the bore the cement is pumped from surface down through the interior of the casing, or through the running string and the liner. Typically, the cement will completely fill the annulus surrounding a liner placed at the bottom or distal end of a bore. Further, in some cases, but not always, an operator will prepare and pump a volume of cement slurry (cement, water, and chemical additives) in excess of the volume of the liner annulus to be filled to ensure the cemented volume matches or exceeds the annular volume to account for any drilled diameter excess and to ensure that the cement extends over and around the seals in the liner hanger. For intermediate liners and casing only a lower or distal section of the annulus may be filled with cement, sufficient to ensure a hydraulic seal and to provide sufficient strength to support the casing or liner.

In conventional well casing or liner cementing operations a float shoe is provided at or adjacent the leading or distal end of the tubing, and a float collar is provided perhaps 80 to 160 feet (24.4 to 48.8 m) above the float shoe and provides a landing for cement wiper plugs; to avoid contamination by well or drilling fluid cement is pumped into the bore between bottom and top wiper plugs. The plugs provide a sliding sealing contact with the inner surface of the tubing and isolate the cement from the drilling fluid that otherwise fills the tubing. When the bottom plug lands on the float collar, continued application of hydraulic pressure from surface ruptures the bottom plug and forces the cement through the plug and the collar, into the volume between the float collar and the float shoe, and then through the float shoe and into the annulus. The cement continues to flow into and fill the annulus until the top plug lands on the bottom plug. The landing of the top plug on the bottom plug is detectable at surface, and at this point the pumping is stopped. This leaves a column of drilling fluid sitting above the top plug and a volume of cement within the distal end of the casing or liner, between the float collar and the float shoe; this volume is known as the shoe track. Typically, this volume of cement is 80 to 160 feet (24.4 to 48.8 m) long.

The provision of the shoe track minimizes the risk of well fluid contamination of the cement which fills the annulus surrounding the bottom of the casing or liner, for example by leakage of well fluid past the top wiper plug. However, when the cement cures the operator is left with a solid plug of cement inside the shoe track.

Methods and apparatus for use in running bore-lining tubing are described in applicant's earlier patents and patent applications, including U.S. Ser. No. 11/448,037B, GB2565180A, GB2565098A, WO2019025798, WO2019025799, WO2017103601, WO2021028689, EP3507447, GB2586585, GB2525148A and GB2545495A, the disclosures of which are incorporated herein in their entirety.

SUMMARY

According to a first aspect of the present disclosure there is provided a well construction method in which a drilled bore is lined with a plurality of successively smaller diameter sections of bore-lining tubing including at least one casing and at least one liner, the well construction method comprising: providing a liner and an inner string extending to a distal end of the liner; running the liner and the inner string into a distal section of a drilled bore; pumping a settable material from surface, through the inner string, and through the distal end of the liner to at least partially fill an outer annulus surrounding the liner, and; permitting at least one of fluid displaced from the outer annulus and a portion of the settable material to flow from the outer annulus through a port in the liner and into an inner annulus between the inner string and the liner.

The disclosure also relates to apparatus for implementing at least part of the method and to a well that has been constructed in accordance with the method.

This aspect of the disclosure may have utility where an operator has identified a casing setting depth which is located in close proximity to a potentially problematic formation, for example porous formations or a low-pressure or weak formation. The use of the inner string to supply the settable fluid, typically cement slurry, to the shoe avoids creation of a cement-filled shoe track which the operator would otherwise likely choose to drill out, running a risk that the shoe track drilling operation would affect the integrity of the cement surrounding the distal end of the liner or breach the problematic formation. Drilling out cement in the shoe track is also very time-consuming, particularly in a sub-sea or deep-water location and can often lead to damage on the internal bore of the liner.

This aspect of the disclosure may also have utility in situations where an operator is seeking to facilitate circulation of fluid via the outer annulus. The outer annulus may comprise a lower portion in which the walls of the annulus are defined by an outer surface of the liner and the unlined wall of the drilled bore. An upper portion of the annulus may be defined by the outer surface of the upper or proximal end portion of the liner and an inner surface of a lower or distal end portion of the last casing. Thus, the upper portion of the annulus is formed at a section of overlap between the distal end of the last casing and the proximal end of the liner. The annular flow area available at this section of overlap is likely to be dimensionally restricted and will thus impede the circulation of fluid through the annulus and generate elevated fluid friction pressures and an increase in equivalent circulation density (ECD). The pressure of the circulating fluid is thus increased. If the lower portion of the outer annulus includes unlined bore wall formed by weak or problematic formations the high pressure circulating fluid or settable material may migrate into those formations, resulting in lost circulation or inefficient cement fill-up of the annulus.

Elevated fluid friction pressures and increases in ECD are a particular issue in some deep-water wells where the casing architecture necessitates the use of dimensionally close tolerance casings, for example where an 18" casing (a casing with an outside diameter of 18" (45.72 cm) and an inside diameter of 16.72" (42.47 cm)) is followed by 16" liner (with an outside diameter of 16" (40.64 cm)). In such a case, locating a 16" liner inside an 18" casing results in a dimensionally restricted annular space between the overlap of the two tubing sections tubing leading to high fluid friction pressure and an increase in ECD during well circulation and cementing operations when fluid has to pass between the tubing sections. The skilled person will understand that passage of fluid through a port or ports in the liner providing a comparable flow area to the annular area between two dimensionally close tolerance casings will generate significantly lower friction pressure than passage through the annular area given that the length of the flow passage through the ports is very short, and likely less than 1" (2.54 cm). Of course, the ports may take any appropriate form, such circular openings or non-circular slots.

The port in the liner may be provided at any appropriate location and may be located below the section of overlap between the distal end of the last casing and the proximal end of the liner. In many operations the port will thus be provided slightly deeper than a shoe provided at the distal end of the casing. The port, with its designed large cross-sectional flow area thus permits circulating fluids to preferentially flow back into the liner. Some or all of the fluid flow may be diverted such that the fluid is not required to flow through the dimensionally restricted upper portion of the outer annulus.

The port may remain open or may be provided with a closure member or otherwise configured to permit the port to be opened and closed. The port may be opened or closed by any suitable mechanism or arrangement, for example a port-operating tool may be mounted on the inner string and may be translated relative to the port to open or close the port.

The port may be closed following the delivery of the settable material.

The inner string may include at least one variable length section, such as a telescopic section, to permit selected parts of the inner string to be translated relative to the liner to, for example, translate a port operating tool.

A plurality of ports may be provided. The ports may be provided in one or more port collars. The liner may be formed of liner sections joined by collars, and at least one of the collars may be ported.

The port collar may include one or more circumferential rows of ports, for example circumferential rows of twelve ports of ¾" (1.9 cm) diameter. In other configurations the ports may be in the form of axial slots.

A shoe may be provided at the lower or distal end of the liner and a running tool may be provided at an upper or proximal end of the liner. The inner string may extend between the shoe and the running tool. In an alternative configuration the inner string may extend from the running tool to a packer located in a lower or distal section of the liner, the packer providing a seal between the liner and the inner string. The inner string may continue beyond the packer to a location just short of the liner shoe.

The method may comprise retrieving the inner string from the bore, and this may include uncoupling the distal end of the inner string from a liner shoe.

The method may further comprise drilling a final section of the bore to intersect a hydrocarbon-bearing formation and locating the liner in the section.

The liner, or at least a portion of the liner extending into or through a hydrocarbon-bearing formation, may be reconfigured to permit fluid to flow from the hydrocarbon-bearing formation into the liner. For example, the liner may be perforated.

The liner may be run into the bore on a running or work string, which work string may be in fluid communication with the inner string. The liner may be run into the bore with the inner annulus in communication with the outer annulus through the open port or via another port. In an alternative configuration the port is closed as the liner is run into the bore.

The bore may be drilled in the seabed. A riser may extend from a mobile offshore drilling unit such as a semi-submersible drilling rig, drill ship or the like to the seabed and the liner may be run into the bore through the riser.

The method may further comprise allowing fluid to flow between the bore and the inner annulus as the liner is run into the bore to equalize pressure therebetween.

The method may further comprise providing a hanger on the liner and activating the hanger to seal and secure the liner to a surrounding bore-lining tubing, such as a previously set casing or liner. The hanger may include an arrangement for securing or fixing the liner to the surrounding bore-lining tubing, for example one or more slips or other gripping arrangements. The previously set casing or liner may include an arrangement for cooperating with the liner hanger. The liner hanger may include an arrangement for sealing an annulus between the liner and the surrounding bore-lining casing, such as one or more packers. The liner hanger may thus form a seal at the upper or proximal end of the outer annulus.

Alternatively, an arrangement may be provided for hanging the liner and sealing an annulus between the liner and the surrounding bore-lining casing at an assembly located at the surface or seabed, such as a wellhead housing assembly (WHHA).

The inner string may feature one or more arrangements like those described in GB2525148A and GB2545495A. The arrangements may permit the distal or leading end of the inner string to be coupled to a liner shoe, and the inner string then be telescopically retracted or compressed to allow a running tool coupled to the proximal or upper end of the inner string to be engaged or disengaged, via a threaded connection, with the proximal or upper end of the liner, without transfer of torque to the distal end of the inner string. Further telescopic retraction or compression may permit a tool provided on the inner string to open or close the liner port. Upper and lower telescopic joints may be provided in the inner string. When the inner string and the running tool are to be retrieved, an upper telescopic joint may be extended to permit the running tool to be disengaged from the liner without disengaging the inner string from the shoe, and the inner string then further extended by further opening of the upper telescopic joint allowing for the port opening tool to engage and open the port. At this stage, with the port open, the fluid flow circulation path is maximized to reduce cement placement pressure and equivalent circulating density.

On completion of the cement job the inner string is further pulled out of the well and the telescopic joints fully extended to enable the transfer of torque to the distal end of the inner string to disengage a threaded or latched-in connection between the inner string and the liner shoe.

The inner string may include an arrangement like that described in GB2565180A or GB2565098A, in which any cement remaining in the distal end of the inner string may be circulated out following closing of a flow port in the liner shoe. Further, the temperature of the fluid that is circulated through the inner string and the inner annulus may be controlled to influence or control the curing of the cement in the outer annulus, as described in GB2565180A. Alternatively, or in addition, a volume of cement may be retained in the inner string and may be retrieved to surface for analysis and testing.

The method may further comprise drilling through the liner shoe with a pilot drill bit.

The method may further comprise allowing fluid to flow between the bore and at least one of the inner string and the inner annulus as the liner is run into the bore to reduce deployment friction or surge pressure. The fluid may be permitted to flow between the bore and the inner annulus via a port collar in the liner.

The method may comprise providing a shoe at the distal end of the liner, a running tool at the proximal end of the liner, with the inner string extending between the shoe and the running tool, and running the liner into the drilled bore while displacing fluid from a volume of the bore below the shoe up through the inner string.

These aspects may have utility in constructing a well featuring close-tolerance tubing, that is tubing that only features small differences in diameter between adjacent bore-lining tubing sections. By providing a flow path through the inner string, and optionally through the inner annulus between the inner string and the liner, it may be possible to run the tubing into the well more quickly while avoiding pressure surging which may, for example, damage the formation surrounding the open hole by forcing well fluid into the formation or inducing the loss of circulating fluid into the formation. Apparatus for implementing these aspects is described in more detail in WO2021028689.

The fluid displaced from the volume of the bore below the shoe may pass through a flow port in the shoe and into the inner string. The flow port may be provided with a float or check valve that is initially held open, or otherwise inactivated, to allow fluid to flow from the volume of the bore below the shoe and into the inner string. Once activated, the check valve prevents flow from the volume below the shoe into the inner string but permits flow from the inner string into the volume. The fluid may pass between the inner string and the inner annulus. In one example the fluid may pass from a distal end of the inner string into a distal end of the inner annulus, and from a proximal end of the inner annulus into a proximal end of the inner string. The displaced fluid may pass from the inner string into a portion or volume of the bore above the running tool. Additionally, displaced fluid may also flow up between the outside diameter of the liner and the inside diameter of the surrounding bore wall or casing and may then flow into the inner annulus via the liner port.

The inner string may be coupled to a running or work string. The work string may support the liner as the liner is run into the bore. Fluid displaced from the bore volume below the shoe may pass from the inner string, into the work string, and then from the work string into a volume surrounding the work string.

A further aspect of the disclosure provides a well construction method comprising: providing a tubing assembly comprising bore-lining tubing and an inner string extending to a distal end of the tubing; advancing the tubing assembly into a drilled bore; and permitting fluid displaced from a distal portion of the bore by the advancing tubing assembly to flow from an outer annulus surrounding the bore-lining tubing through a port in the tubing and into an inner annulus between the inner string and the tubing.

A still further aspect of the disclosure provides well construction apparatus comprising: a tubing assembly including: bore-lining tubing having a wall and a fluid port in the wall, and an inner string extending to a distal end of the bore-lining tubing, whereby fluid displaced by advancing the tubing assembly into a drilled bore flows from an outer annulus surrounding the bore-lining tubing through the port in the tubing wall and into an inner annulus between the inner string and the tubing.

The various features described above may have individual utility. Further, the various features described above with reference to one of the aspects, and as recited in the dependent claims below, may also be provided in combination with one or more of the other aspects.

The steps of the various methods may be carried out sequentially in the order as described. However, some steps may be carried out simultaneously, or may at least partially overlap. Alternatively, the steps may be carried out in a different sequence.

BRIEF DESCRIPTION OF THE DRAWINGS

These and other aspects of the disclosure will now be described, by way of example, with reference to the drawings, in which.

DETAILED DESCRIPTION

Figure 1:
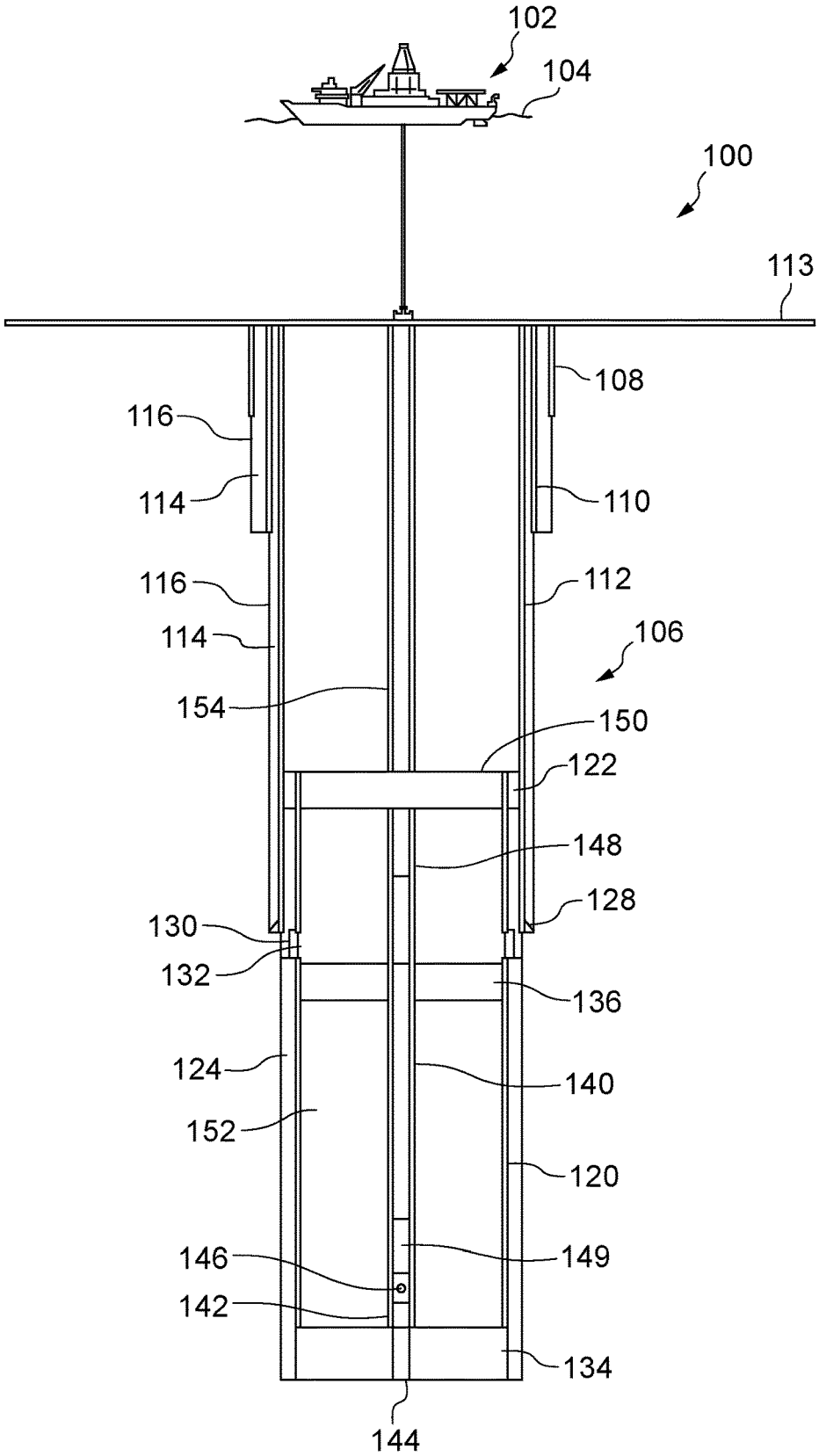
FIGS. 1 and 2 are schematics of an oil and gas well illustrating an example of a well construction method and apparatus in accordance with an aspect of the present disclosure.

Referring first to FIG. 1 of the drawings, a deep-water oil and gas well 100 is illustrated. Well construction operations are conducted primarily from a mobile offshore drilling unit 102 on the sea surface 104. The well 100 includes a bore 106 which has been drilled in sections and lined with successively smaller bore-lining tubing sections 108, 110, 112, 120.

The illustrated well 100 includes three casing sections 108, 110 and 112 which extend back to a wellhead housing assembly (WHHA) located at the seabed 113 and serve to support the surrounding bore wall, which may include weak zones which would otherwise be liable to collapse. The casings 108, 110, 112 also isolate any water, gas or oil-bearing zones and provide support for the next casing. An annulus 114 surrounds the two innermost casings 110, 112 and is at least partially filled with settable material in the form of cement 116.

The well 100 also includes a liner 120 which extends to the end of the bore 106. The liner 120 may have a generally similar form to the casings 108, 110, 112 but does not extend back to the seabed 113. In this example the liner 120 is sealed and secured to a distal portion of the innermost or last casing 112 with a liner hanger 122. An outer annulus 124 between the liner 120 and the surrounding bore wall will also be sealed with cement 126.

In the illustrated well 100 the first casing 108, sometimes referred to as a conductor, has been placed by jetting, that is by providing a shoe on the lower or distal end of the casing 108 and pumping water through jetting nozzles in the shoe to displace sediment and allow the casing 108 to be lowered into the seabed 113. In other situations, the casing 108 may have been run into a drilled bore and then sealed and secured in the bore within a cement sheath.

Figure 2:
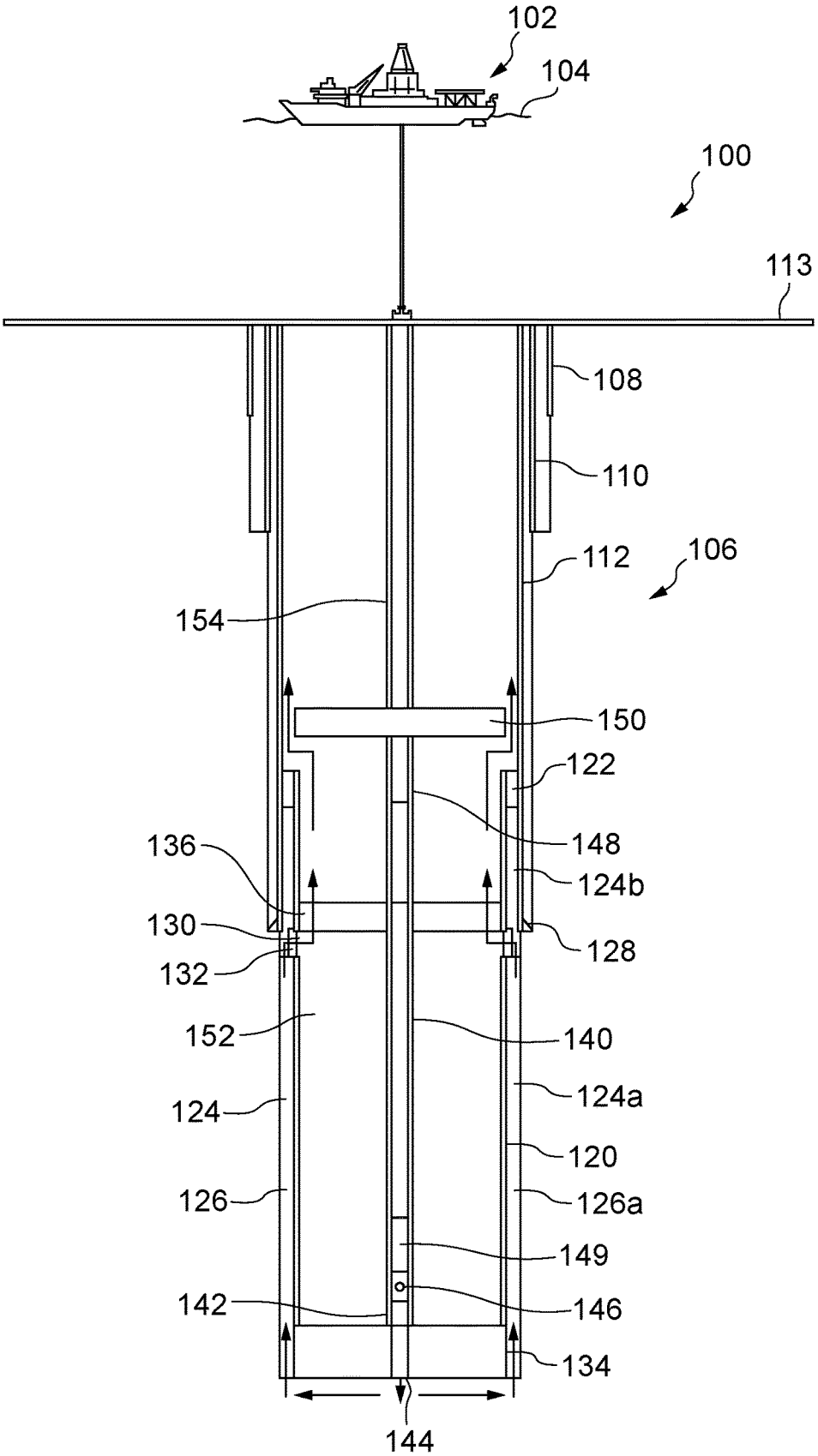

The second casing 110 is next located in the bore 106, followed by the third casing 112. A shoe 128 in the lower end of the casing 112 is then drilled out and a continuation of the bore 106 is then drilled and under reamed beyond the end of the casing 112. The liner 120 is then run into and cemented in the bore 106, as described in detail below and as illustrated in FIG. 2.

The liner 120 is made up from liner sections stored on the deck of the drilling unit 102. The leading or distal end of the liner 120 is provided with a liner shoe 134. The shoe 134 is a float shoe and allows an end adaptor/connector 142 on the end of an inner string 140 to form a sealing engagement with the shoe 134, as will be described. The inner string 140 will typically be of significantly smaller diameter than the liner 120.

The liner sections are coupled together using collars which typically feature female threaded ends for engaging male threads on the ends of the liner sections. One of the collars 130 includes ports 132 which may be opened to permit fluid to flow between the outside and the inside of the liner 120. The port collar 130 is located on the liner 120 such that, when the liner 120 has been run into the bore 106 to target depth, as illustrated in FIG. 1, the collar 130 is located just below the previous casing shoe 128.

In one example the collar 130 is provided with circumferential rows of twelve ports of ¾" (1.9 cm) diameter. The collar 130 may feature an internal sleeve that is axially translated to open and close the collar 130 and uncover/cover the ports 132. The collar 130 may be similar in form to a stage cementing collar, examples of which are supplied by TAM International, Inc., Archer Limited and Forum Energy Technologies, Inc.

Once the liner 120 has been made up and is suspended from the slips on the deck of the drilling unit 102, the inner string 140 is made up and run into the liner 120. The inner string 140 includes an end connector 142 which may be latched into a flow passage 144 in the liner shoe 134. The flow passage 144 features a float or check valve which prevents flow of fluid from below the shoe 134 and into the inner string 140 while permitting flow from the inner string 140 through the flow passage 144 and out of the shoe 134 and into the outer annulus 124. The end connector 142 may be disengaged from the shoe 134 by rotating the connector 142 relative to the shoe 134, or by a straight pull.

The lower or distal end of the inner string 140 includes a valved port 146 including a burst disc or the like. The valve in the port 146 is initially closed.

The inner string 140 also includes upper and lower telescopic sections or slip joints 148, 149. When the telescopic sections 148, 149 are extended, complementary splined portions engage and permit the transfer of torque through the sections 148, 149. However, when a section 148, 149 is retracted or compressed a portion of the string 140 above the section 148, 149 is rotatable relative to a portion below the portion 148, 149. The telescopic sections 148, 149 may include features such as described in GB2525148A and GB2545495A, the disclosures of which are incorporated herein in their entirety.

Further, the inner string 140 is provided with a port collar shifting tool 136. As will be described, the shifting tool 136 may be translated relative to the port collar 130 to open and close the ports 132.

Once the inner string 140 has been made up to the appropriate length within the liner 120 the end connector 142 may engage and connect with the liner shoe 134. Pulling back on the string 140 will confirm that the connector 142 and shoe 134 are properly engaged.

The upper or proximal end of the inner string 140 is then coupled to a liner running tool 150 which includes external left-handed threads configured to cooperate with matching internal threads on the upper or proximal end of the liner 120. In other examples an alternative or supplementary coupling arrangement may be employed between the running tool 150 and the liner 120, for example cam-actuated load shoulders.

The inner string 140 is then lowered to compress the telescopic sections 148, 149 such that the splined portions disengage. The upper end of the string 140 may then be rotated to engage the running tool 150 with the upper end of the liner 120, without transfer of rotation to the string 140 below the section 148.

An inner annulus 152 between the liner 120 and the inner string 140 may be top filled with drilling fluid before engaging the running tool 150 with the liner 120. Also, the inner string 140 may be top filled, as may a liner running string 154 which is subsequently connected to the liner assembly. The top filling may be achieved simply be locating a hose outlet in the upper end of the annulus 152 or string 140, 154 and pumping drilling fluid into the annulus 152 or string 140, 154, or by use of apparatus such as the Top Jet (trademark) tool supplied by Coretrax Global Limited.

The resulting liner assembly is lowered into the well supported by the liner running string 154 until the liner 120 reaches target depth. The liner hanger 122 provided at the upper end of the liner 120 may be activated and slips and seals in the hanger 122 engage the surrounding casing 112. This stage of the well construction process is illustrated in FIG. 1. Alternatively, the hanger seals may be initially inactive and be activated subsequently.

The upper end of the string 140 may then be rotated to disengage the running tool 150 from the upper end of the liner 120, opening the upper end of the inner annulus 152. The inner string 140 may then be lifted to bring the port collar shifting tool 136 into engagement with the port collar 130. By appropriate manipulation of the tool 136 the port collar 130 may be reconfigured, and the port 132 opened. In other examples the port 132 may be initially open and not require reconfiguration.

The liner 120 is surrounded by the outer annulus 124 which comprises a lower portion **124*a* in which the walls of the annulus are defined by an outer surface of the liner 120 and the wall of the drilled bore 106. An upper portion 124*b* of the annulus is defined by the outer surface of the upper or proximal end portion of the liner 120 and an inner surface of a distal end of the last casing section 112. Thus, the upper portion 124*b* of the annulus is formed at a section of overlap between the lower or distal end of the last casing 112 and the proximal end of the liner 120. The annular flow area provided at this section of overlap is restricted and will thus impede any attempt to circulate fluid through the annulus 124 and will generate elevated fluid friction pressures and an increase in equivalent circulation density (ECD); the pressure of the circulating fluid would thus be increased. If the lower portion 124***a* of the outer annulus includes drilled bore wall formed by weak or problematic formations the high pressure circulating fluid or higher density settable material may migrate into those formations, resulting in lost circulation or inefficient cement fill-up of the annulus. As described below, the apparatus and method of this example may be utilized to provide at least partial fluid bypass of the restricted area 124*b*.

After the liner 120 is located in the bore 106 and secured to the casing using the liner hanger 122, the operator may then circulate a cementing fluid train, which involves pumping various fluids down through the liner running string 154, the liner running tool 150, the inner string 140, and through the flow port 144 in the shoe 134. The fluids will flow into and up through the outer annulus 124. The port collar 130 is located between the lower and upper annulus portions 124*a*, 124*b* and as the fluid reaches the level of the port collar 130 the fluid will divert from the outer annulus 124 and flow through the ports 132 and into the inner annulus 152. If the seals on the liner hanger 122 have been set all of the circulating fluid will pass through the ports 132. However, if the seals have not been set some fluid may continue to flow up through the annulus upper portion 124*b*.

The fluid train may comprise, for example, wash fluid, spacer fluid, lead cement slurry, tail cement slurry, and displacement fluid. From the inner annulus 152 the fluids will flow up and around the disconnected running tool 150, or through a fluid bypass system provided at the upper end of the liner 120.

The circulating fluid does not have to negotiate the extended length of the restricted area flow path between the overlapping upper or proximal end of the liner 120 and lower or distal end of the casing 112, or flow through or around the liner hanger 122. The less restrictive flow path available through the ports 132 minimizes fluid friction pressure, encourages preferential flow, and provides a corresponding reduction in ECD. It should be noted that even if the ports 132 provide a smaller flow area than the upper annular portion 124*b*, the passage of fluid through the ports 132 will generate significantly lower friction pressure than passage of fluid through the annular portion 124*b* given that the length of the flow passage through the ports 132 is very short, and likely less than 1" (2.54 cm).

Reverse flow of the relatively dense cement slurry 126*a* from the annulus 124 back into the inner string 140 is prevented by the check valve provided in the port 144.

The cement slurry 126*a* may be separated from the following displacement fluid by an inner string top wiper plug or ball. The cement 126*a* is thus pumped through the liner running string 154, the liner running tool 150, the inner string 140, and the flow port 144 in the shoe 134, until the ball lands in and blocks the flow port 144. The ball is locked in the port 144 and acts in combination with the flow port check valve to prevent any possibility of U-tubing, that is the dense cement slurry 126*a* flowing out of the annulus 124, and back through the port 144, and into the inner string 140.

A valved port 146 closed with a shear or burst disc is provided in the lower end of the inner string 140 and by continuing to pump into the now closed-off inner string 140 the port 146 may be opened.

By manipulation of the inner string 140 the operator may also translate the shifting tool 136 to close the ports 132 and isolate the outer annulus 124.

If desired, fluid may be conventionally or reverse circulated through the inner annulus 152 and any residual cement 126*a* in the string 140 or liner 120 is flushed out of the well; fluid may be pumped into the inner annulus 152 from the bore volume above the running tool 150, and then through the port 146 and up through the inner string 140 to surface, or fluid may be pumped into inner string 140 and then through the port 146 and up through the inner annulus 152 to surface.

The operator may also circulate fluid through the inner annulus 152 to affect the setting of the cement 126*a*, as discussed in detail in GB2565098A and U.S. Ser. No. 11/448,037B. For example, the circulation of heated fluid may accelerate the setting of the cement 126*a*, whereas circulation of cooled fluid may retard cement setting.

When the operator is ready to retrieve the liner running assembly, the liner running string 154 is raised to extend the telescopic sections 148, 149 in the inner string 140, allowing torque to be transferred through the inner string 140 to disengage the bottom end of the inner string 140 from the liner shoe 134.

Once the cement 126 has set, any further operations, for example perforating the liner 120, may be carried out immediately. There is no requirement to drill out a plug of cement, or the associated plugs and float collar, from the distal end of the liner 120, as would be the case with a conventional liner cementing operation. This provides for a considerable saving in time, reduces the equipment required to be provided on the drilling unit 102, avoids the potential for drilling-related damage to the liner 120 and the cement 126.

Figure 3:
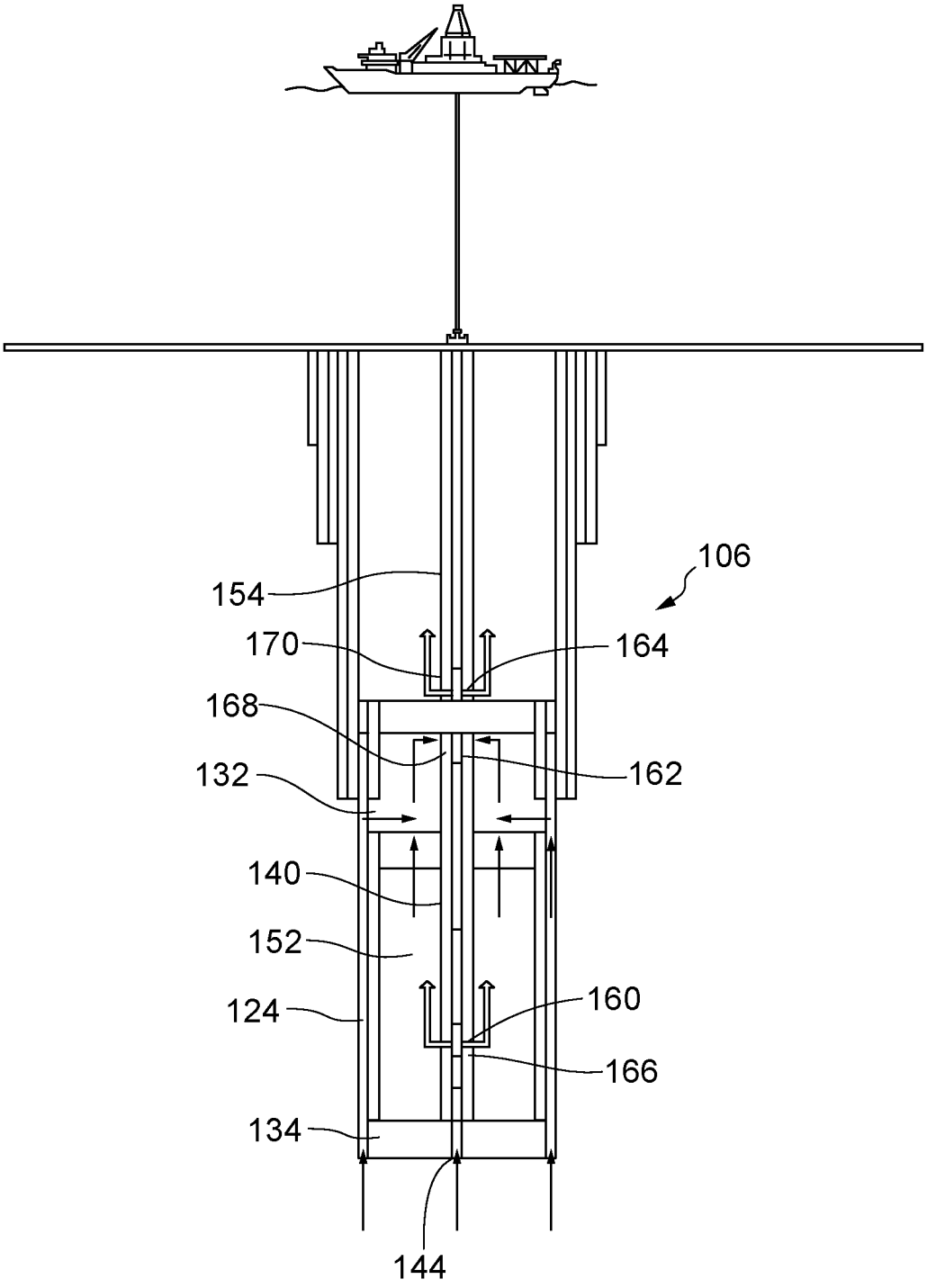
FIG. 3 is a schematic of an oil and gas well illustrating an example of a well construction method and apparatus in accordance with another aspect of the present disclosure.

In another example a liner assembly, such as illustrated in FIG. 3 of the drawings, may be run into the bore 106 with the ports 132 open so that fluid in the bore may pass from the bore 106 and the outer annulus 124 into the inner annulus 152. If the inner string 140 and the running string 154 are configured in a similar manner to the strings as described in applicant's WO2021028689, and the check valve in the flow passage 144 is initially held open, bore fluid displaced from the volume below the shoe 134 may pass from the volume into the inner string 140 through the open flow passage 144, and fluid may also pass from the outer annulus 124 into the inner annulus 152 through the ports 132. Also, open diverter ports 160, 162, 164 provided in flow subs 166, 168, 170 in the inner string 140 and the running string 154 allow fluid to pass between the inner string 140 and the inner annulus 152 and between the running string 154 and the bore volume above the running tool 150. The creation of such additional potential flow paths minimizes the resistance to upwards flow of fluid once the fluid has entered the inner string 140 through the flow passage 144 and facilitates flow from the inner annulus 152 and into the bore volume above the running tool 150.

Once the liner 120 is at target depth the diverter ports 160, 162, 164 may be closed and the check valve in the passage 144 activated.

Such an arrangement may facilitate running the liner assembly into the bore more quickly while avoiding pressure surging which may, for example, damage the formation surrounding the open hole by forcing well fluid into the formation or inducing the loss of circulating fluid into the formation.

It will be apparent to the skilled person that many of the elements of the various well constructions described above may be modified or omitted. For example, the skilled person would recognize that the number and dimensions of the various casing and liner sections may differ in other wells.

In the examples described above the inner string extends to a shoe provided at the lower or distal end of the liner. However, in other examples the inner string may extend to a packer which locates the inner string in the liner and provides a seal between the inner string and the liner. The inner string may terminate at the packer or may extend beyond the packer to a location just short of the liner shoe. Thus, in such an arrangement a section of the liner may provide fluid communication between the end of the inner string and the shoe and the outer annulus. Further, the drawings illustrate methods being utilized in deep-water applications. The skilled person will recognize that the methods and apparatus described may also be utilized in shallower water, and indeed in land wells.

The invention claimed is:

1. A well construction method in which a drilled bore is lined with a plurality of successively smaller diameter sections of bore-lining tubing including at least one casing and at least one liner, the well construction method comprising:

providing a liner and an inner string extending to a distal end of the liner;

running the liner and the inner string into a distal section of a drilled bore;

pumping a settable material from surface, through the inner string, and through the distal end of the liner to at least partially fill an outer annulus surrounding the liner;

permitting at least one of fluid displaced from the outer annulus and a portion of the settable material to flow from the outer annulus through a port in the liner and into an inner annulus between the inner string and the liner;

locating the port in the liner such that when the liner is run into the bore the port is located below a section of overlap between a distal end of a previous casing and a proximal end of the liner; and opening or closing the port; and running the liner into the bore with the port in a closed configuration.

2. The method of claim 1, comprising mounting a port collar shifting tool on the inner string and translating the tool relative to the port to reconfigure the port.

3. The method of claim 1, further comprising closing the port following the filling of the outer annulus with the settable material.

4. The method of claim 1, further comprising providing a telescopic section in the inner string and reconfiguring the telescopic section between extended and retracted configurations, in one of the configurations the telescopic section being capable of transferring torque and in the other of the configurations the telescopic section permitting independent rotation of portions of the inner string above and below the telescopic section.

5. The method of claim 1, further comprising providing the port in a port collar.

6. The method of claim 1, further comprising providing a shoe at the distal end of the liner and a running tool at the proximal end of the liner, with the inner string extending between the shoe and the running tool.

7. The method of claim 1, further comprising retrieving the inner string from the bore.

8. The method of claim 1, further comprising running the liner into the bore on a work string in fluid communication with the inner string.

9. The method of claim 1, further comprising running the liner into the bore with the inner annulus in fluid communication with the outer annulus, wherein the inner annulus is further in communication with a volume of the bore above the liner.

10. The method of claim 1, further comprising providing a hanger on the liner and activating the hanger to secure and seal the liner to the previous casing.

11. The method of claim 1, further comprising circulating fluid through the inner annulus to heat or cool the settable material in the outer annulus.

12. A well construction apparatus for use in lining a drilled bore, the well construction apparatus comprising:

a liner having a wall and a fluid port in an upper portion of the wall;

an inner string for extending to a distal end of the liner; and a telescopic section in the inner string between extended and retracted configurations, in one of the configurations the telescopic section being capable of transferring torque and in the other of the configurations the telescopic section permitting independent rotation of portions of the inner string above and below the telescopic section;

whereby fluid may be pumped through the inner string, through a distal end of the liner to at least partially fill an outer annulus surrounding the liner, and from the outer annulus through the port in the liner and into an inner annulus between the inner string and the liner; and wherein the fluid port is configurable in an open configuration and in a closed configuration.

13. The apparatus of claim 12, wherein the port is provided in a port collar.

14. The apparatus of claim 12, wherein a port collar shifting tool is mounted on the inner string and translatable relative to the port to open or close the port.

15. The apparatus of claim 12, wherein the inner string includes at least one telescopic section to permit selected parts of the inner string to be translated relative to the liner.

16. The apparatus of claim 12, further comprising a shoe at the distal end of the liner and a running tool at a proximal end of the liner, and wherein the inner string extends between the shoe and the running tool, wherein inner string includes an end connector for releasably connecting a distal end of the inner string to the shoe.

17. The apparatus of claim 13, wherein the inner string comprises a valved port openable to permit fluid transit between the inner string and the inner annulus.

18. A well construction method comprising:

providing a tubing assembly comprising bore-lining tubing and an inner string extending to a distal end of the tubing;

advancing the tubing assembly into a drilled bore;

permitting fluid displaced from a distal portion of the bore by the advancing tubing assembly to flow from an outer annulus surrounding the bore-lining tubing through a port in the tubing and into an inner annulus between the inner string and the tubing;

locating the port in the liner such that when the liner is run into the bore the port is located below a section of overlap between a distal end of a previous casing and a proximal end of the liner;

opening or closing the port; and providing a telescopic section in the inner string and reconfiguring the telescopic section between extended and retracted configurations, in one of the configurations the telescopic section being capable of transferring torque and in the other of the configurations the telescopic section permitting independent rotation of portions of the inner string above and below the telescopic section.

19. A well construction apparatus comprising:

a tubing assembly including:

bore-lining tubing having a wall and a fluid port in the wall, and an inner string extending to a distal end of the bore-lining tubing, whereby fluid displaced by advancing the tubing assembly into a drilled bore flows from an outer annulus surrounding the bore-lining tubing through the port in the tubing wall and into an inner annulus between the inner string and the tubing;

wherein the fluid port is configurable in an open configuration and in a closed configuration; and wherein the bore-lining tubing is run into the tubing assembly with the fluid port in the closed configuration.

* * * * *